US006948880B2

(12) United States Patent
Cicinnati

(10) Patent No.: US 6,948,880 B2
(45) Date of Patent: Sep. 27, 2005

(54) GUARDRAIL TERMINAL

(75) Inventor: Luigi Cicinnati, Padova (IT)

(73) Assignee: Metalmeccanica Fracasso S.p.A., Via Barbariga (IT)

( * ) Notice: Subject to any disclaimer, the term of this patent is extended or adjusted under 35 U.S.C. 154(b) by 0 days.

(21) Appl. No.: 10/601,053

(22) Filed: Jun. 20, 2003

(65) Prior Publication Data

US 2004/0062603 A1 Apr. 1, 2004

(30) Foreign Application Priority Data

Jul. 16, 2002 (IT) ..... TO2002A0620

(51) Int. Cl.[7] ..... E01F 15/00
(52) U.S. Cl. ..... 404/6; 404/10; 256/13.1
(58) Field of Search ..... 404/6, 10; 256/13.1

(56) References Cited

U.S. PATENT DOCUMENTS

| | | | | | |
|---|---|---|---|---|---|
| 2,154,818 | A | * | 4/1939 | Mayer | 256/13.1 |
| 2,776,116 | A | * | 1/1957 | Brickman | 256/13.1 |
| 4,330,106 | A | | 5/1982 | Chisholm | |
| 5,791,812 | A | * | 8/1998 | Ivey | 404/6 |
| 6,024,341 | A | * | 2/2000 | Gertz | 256/13.1 |
| 6,142,452 | A | * | 11/2000 | Denman et al. | 256/13.1 |
| 6,575,434 | B2 | * | 6/2003 | Bligh et al. | 256/13.1 |

FOREIGN PATENT DOCUMENTS

| | | | |
|---|---|---|---|
| EP | 1 186 714 | * | 3/2002 |
| EP | 1 382 748 | * | 1/2004 |
| JP | 9-170211 | * | 6/1997 |

* cited by examiner

*Primary Examiner*—Gary S. Hartmann
(74) *Attorney, Agent, or Firm*—Patterson, Thuente, Skaar & Christensen P.A.

(57) ABSTRACT

A guardrail terminal having a number of vertical supporting members fix into the ground one after the other along the edge of the road. The guardrail terminal, in certain embodiments, has a curved or straight first transverse horizontal retaining member fixed to the vertical supporting members at a given height off the ground, and curves in the horizontal plane so as to extend gradually away from the edge of the road. The guardrail terminal further may include a curled second transverse horizontal retaining member, which projects from the terminal end of the first transverse horizontal retaining member, curves back in the horizontal plane towards the first transverse horizontal retaining member, and is fixed by its own terminal end to the start end or to an intermediate portion of the first transverse horizontal retaining member, so as to form, together with the first transverse horizontal retaining member, a substantially tear-shaped collapsible annular member.

7 Claims, 2 Drawing Sheets

GUARDRAIL TERMINAL

The present invention relates to a guardrail terminal.

More specifically, the present invention relates to a metal-guardrail terminal, to which the following description refers purely by way of example.

BACKGROUND OF THE INVENTION

As is known, metal guardrails normally comprise a number of vertical supporting posts fixed into the ground one after the other along the edge of a road; and a number of transverse horizontal retaining members fixed to the vertical supporting posts one after the other to form a straight longitudinal retaining strip extending continuously along the edge of the road at a given height off the ground.

When the guardrail starts at a fork in the road or alongside particularly hazardous obstacles, the start end of the guardrail is normally covered with safety structures for retaining or redirecting vehicles towards the centre of the road, depending on whether the impact trajectory of the vehicle against the end of the guardrail is tangent or not to the guardrail, and with deceleration obviously below current regulation thresholds.

Safety structures for the above purpose are normally referred to as "guardrail terminals", and normally comprise a reinforced-concrete base at ground level; a number of vertical supporting posts arranged successively in a U on the reinforced-concrete base, starting from the end of the guardrail; a number of programmed-yield anchoring bolts for securing each vertical supporting post firmly to the reinforced-concrete base; and a number of collapsible horizontal longitudinal members fixed telescopically one after the other to the vertical supporting posts to form a collapsible, substantially horseshoe-shaped horizontal beam, i.e. U-shaped in a horizontal plane.

Another commonly used type of guardrail terminal comprises a prismatic, triangular-based tank made of plastic material, anchored to the ground immediately upstream from the start end of the guardrail, and filled with water to absorb the impact of the vehicle.

Another type of guardrail terminal comprises a thin metal tubular member fixed vertically and directly to the vertical supporting post at the end of the guardrail.

The first type of guardrail terminal described above has the drawback of being extremely expensive to produce, and of failing to effectively absorb the kinetic energy of the vehicle in collisions involving a vehicle travelling on the other side of the road, i.e. when the vehicle is travelling on the opposite side of the road to the edge bounded by the guardrail, and strikes the rear of the terminal, possibly after scraping against the end/initial portion of the guardrail.

Though decidedly cheaper to produce, the other guardrail terminals described above provide for fairly poor absorption of the kinetic energy of the vehicle, and are therefore only suitable for installation on slow roads.

SUMMARY OF THE INVENTION

It is an object of the present invention to provide a guardrail terminal designed to eliminate the drawbacks typically associated with known types.

According to the present invention, there is provided a guardrail terminal, characterized by comprising a number of vertical supporting members fixed to the ground one after the other along the edge of the road; a first transverse horizontal retaining member fixed to the vertical supporting members at a given height off the ground, and positioned in the horizontal plane so as to extend gradually away from the edge of the road, as of the end of the guardrail; and a curled second transverse horizontal retaining member, which projects from the terminal end of said first transverse horizontal retaining member, curves back in the horizontal plane towards said first transverse horizontal retaining member, and is fixed by its own terminal end to the start end or to an intermediate portion of said first transverse horizontal retaining member, so as to form, together with the first transverse horizontal retaining member, a substantially tear-shaped collapsible annular member.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
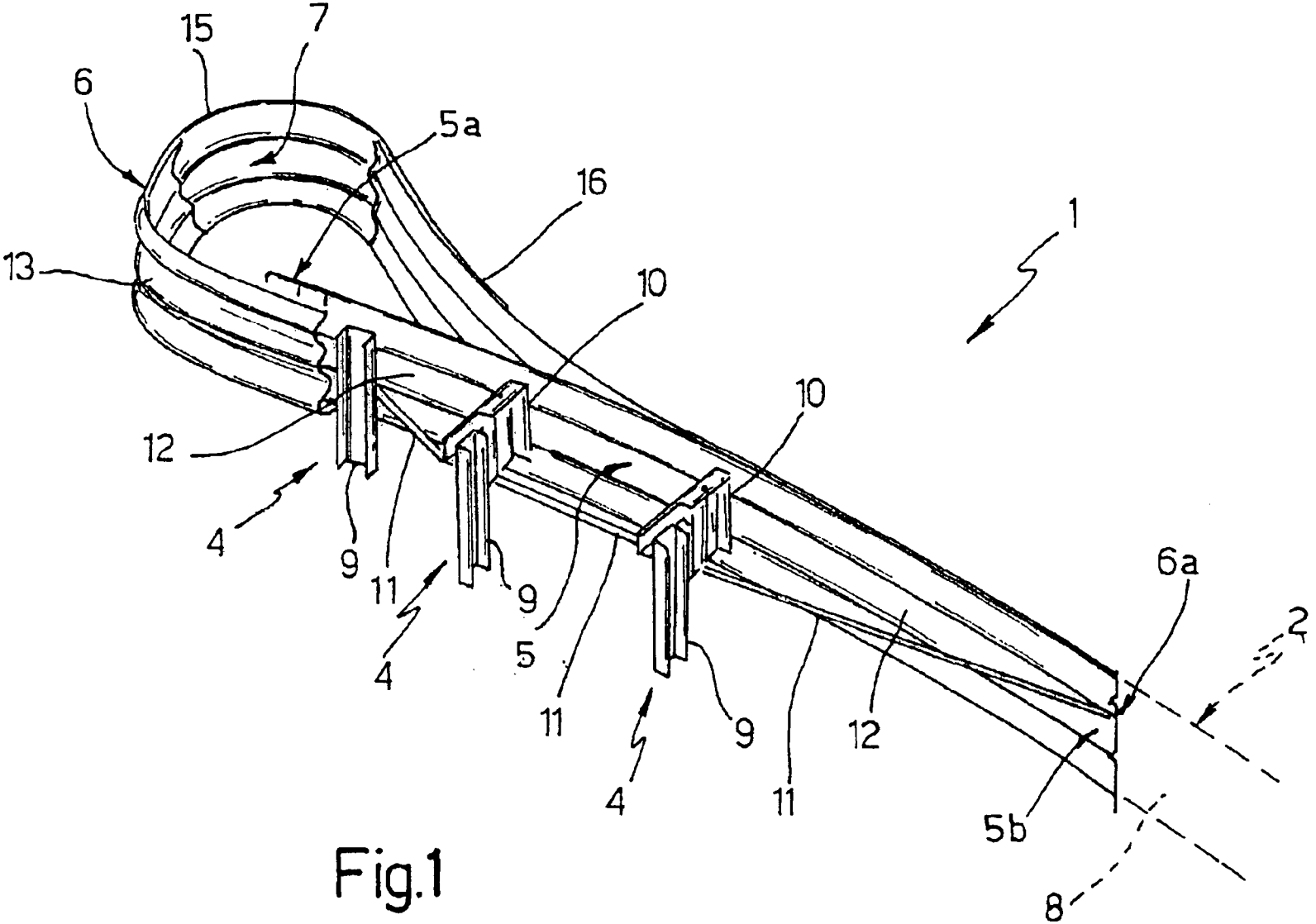
FIG. 1 shows a view in perspective of a guardrail terminal in accordance with the teachings of the present invention.

Number 1 in the accompanying drawings indicates as a whole a guardrail terminal designed for assembly to the end of a known metal guardrail 2 extending along the edge 3 of any asphalted road or similar.

Two specular terminals 1 may obviously also be assembled one after the other and connected to each other to form a short safety barrier surrounding small-sized obstacles, such as large trees or reinforced-concrete posts, along edge 3 of the road.

Terminal 1 substantially comprises a number of vertical supporting members 4 fixed into the ground one after the other along edge 3 of the road; a curved first transverse horizontal retaining member 5 fixed to vertical supporting members 4 at a given height off the ground, and curving, in a horizontal plane and with a preferably, though not necessarily, constant radius of curvature, gradually away from edge 3 of the road as of the end of guardrail 2; and a curled second transverse horizontal retaining member 6, which projects from the terminal end 5*a* of transverse horizontal retaining member 5, curves back with a variable radius of curvature in the horizontal plane towards first transverse horizontal retaining member 5, and is fixed by its own terminal end 6*a* to the start end 5*b* or to an intermediate portion of transverse horizontal retaining member 5, so as to form, together with transverse horizontal retaining member 5, a substantially tear-shaped collapsible annular member 7.

More specifically, in the example shown, terminal 1 is designed for assembly to the end of guardrail 2, so that the start end 5*b* of transverse horizontal retaining member 5 can be fixed directly, by bolts or similar fastening systems, to the end of the last transverse horizontal retaining member 8 of guardrail 2.

Figure 3:
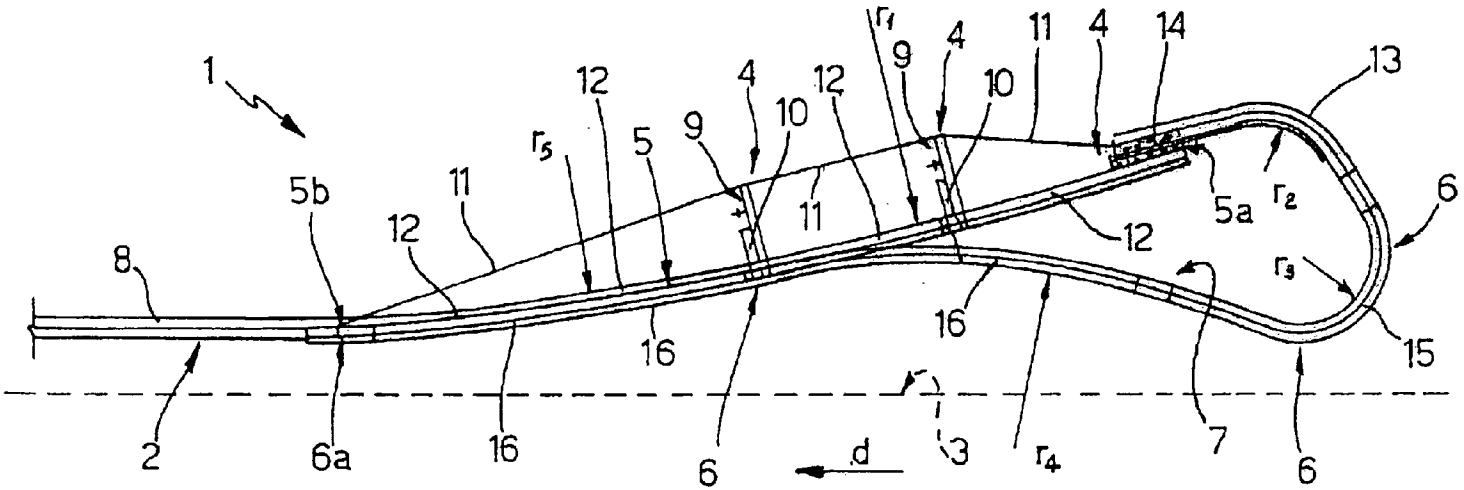
FIG. 3 shows a plan view of the FIG. 1 guardrail terminal.

With reference to FIGS. 1 and 3, in the example shown, vertical supporting members 4 are three in number, and are fixed into the ground one after the other along edge 3 of the road along a curved path T, which extends gradually away from edge 3 of the road, as of the end of guardrail 2.

More specifically, the three vertical supporting members 4 are fixed into the ground and so spaced apart that a first vertical supporting member 4 supports terminal end 5*a* of transverse horizontal retaining member 5, while the other two vertical supporting members 4 support the central portion of transverse horizontal retaining member 5.

In the example shown, the vertical supporting member 4 supporting terminal end 5*a* of transverse horizontal retaining member 5 is defined by a U-section metal bar 9 driven directly into the ground in a vertical position, and fixed at the top end directly to transverse horizontal retaining member 5 by bolts, rivets, or similar fastening systems.

Each of the other two vertical supporting members 4 is defined by a U-section metal bar 9 driven directly into the ground in a vertical position, and by a collapsible spacer member 10 interposed between the top end of metal bar 9 and the body of transverse horizontal retaining member 5. In the example shown, collapsible spacer member 10 is fixed stably to transverse horizontal retaining member 5 by rivets or similar fastening systems, and is fixed to the top end of metal bar 9 by through bolts inserted inside slots formed in programmed-deformation portions of collapsible spacer member 10.

Preferably, though not necessarily, vertical supporting members 4 are provided with a twist plate 11 connecting metal bars 9 of the three vertical supporting members 4 in known manner to one another and to the ground and/or transverse horizontal retaining members 5 and 6, to prevent the bodies of metal bars 9 from twisting, in the event of impact by a vehicle, and so impairing the ability of the bodies to discharge mechanical stress to the ground.

Figure 2:
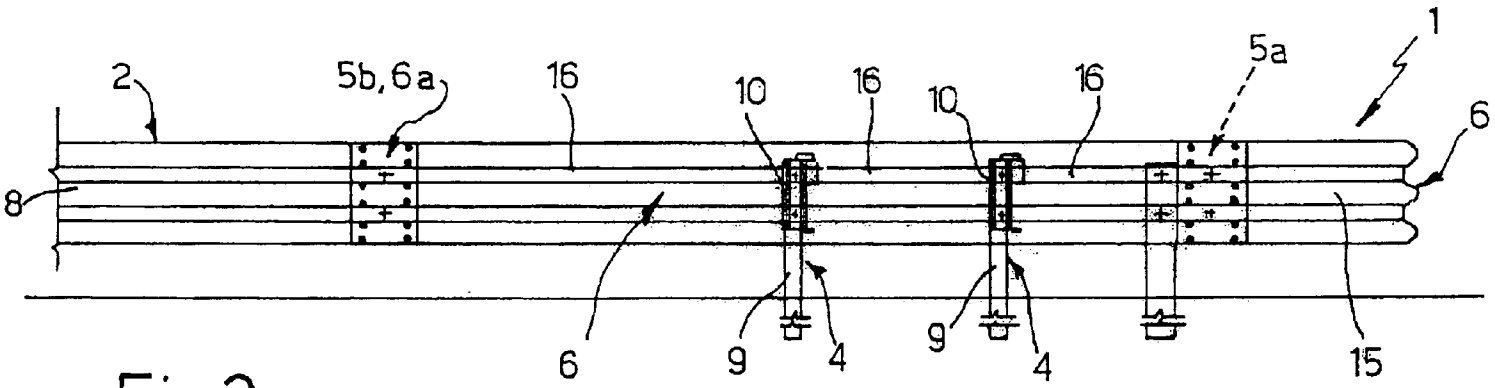
FIG. 2 shows a front view of the FIG. 1 guardrail terminal.

In the example shown in FIGS. 1, 2 and 3, curved transverse horizontal retaining member 5 is defined by a single segment 12 of corrugated sheet metal with a W-shaped cross section or three longitudinal ridges (also known as three-ridge section), which curves in the horizontal plane with a constant radius of curvature $r_1$ preferably, though not necessarily, ranging between 14 and 15 metres. Alternatively, a sheet metal segment 12 with a variable radius of curvature $r_1$ may obviously also be used.

In the example shown, curled transverse horizontal retaining member 6 is defined by three segments of W- or three-ridge-section corrugated sheet metal, the first of which, hereinafter indicated 13, defines an extension of segment 12, and is bent substantially into an L in the horizontal plane, so that the central portion has a preferably, though not necessarily, constant radius of curvature $r_2$ ranging between 0.4 and 0.6 of a metre.

It should be pointed out that, in the example shown, the end of segment 13 is fixed to the end of segment 12 by a connecting member 14 for stably connecting two specularly positioned pieces of W- or three-ridge-section corrugated sheet metal.

The second W- or three-ridge-section segment of corrugated sheet metal, hereinafter indicated 15, defines an extension of segment 13, to which it is fixed by rivets, self-locking bolts or similar fastening systems, and is bent substantially into a V in the horizontal plane, so that the central portion has a constant radius of curvature $r_3$ ranging between 0.4 and 0.6 of a metre.

The third W- or three-ridge-section segment of corrugated sheet metal, hereinafter indicated 16, defines an extension of segment 15, to which it is fixed by rivets, self-locking bolts or similar fastening systems, and is bent substantially into an S in the horizontal plane, so that the first portion has a constant radius of curvature $r_4$ ranging between 3 and 4 metres, and the second portion has a constant radius of curvature $r_5$ substantially equal to radius of curvature $r_1$ of segment 12, so that part of the length of the second portion overlaps segment 12.

The second end of segment 16 obviously defines terminal end 6*a* of transverse horizontal retaining member 6, and is fixed directly to the body of segment 12 by rivets, self-locking bolts or similar fastening systems. In the example shown, the second end of segment 16 is fixed directly onto the start end of segment 12, in turn defining the start end 5*b* of transverse horizontal retaining member 5.

In a different embodiment not shown, segment 16 may be straight, at least along the second portion, so that it only comes into direct contact with the surface of segment 12 close to the point at which it is fastened to the end of segment 12.

In the example shown, corrugated sheet metal segments 13, 15 and 16 are all the same thickness, but sheet metal segments of different thicknesses may be used to maximize absorption of the kinetic energy of the vehicle as a function of the maximum deceleration to which the vehicle and occupants are subjected.

Transverse horizontal retaining member 6 may obviously also be made of a single segment of W- or three-ridge-section corrugated sheet metal, at slightly higher production cost.

Operation of terminal 1 is easily deducible from the above description and attached drawings, with no further explanation required.

It should be stressed, however, that the shape of transverse horizontal retaining members 5 and 6, i.e. the tear shape of collapsible annular member 7, effectively slows down the vehicle, in the event of impact, and provides, at the initial impact stage, for maximum deceleration well below current safety regulation thresholds.

At the initial impact stage, in fact, the kinetic energy of the vehicle is absorbed solely by deformation of transverse horizontal retaining member 6; transverse horizontal retaining member 5 only being involved later, when transverse horizontal retaining member 6 is fully collapsed and has transferred all the mechanical stress to transverse horizontal retaining member 5.

The curved shape of transverse horizontal retaining member 5 also provides for redirecting the vehicle towards the centre of the road, even in the worst-case impact conditions, i.e. when the impact trajectory of the vehicle is parallel to the normal travelling direction d.

Conversely, in the above impact conditions, known guardrail terminals simply absorb all the kinetic energy of the vehicle, with considerable deceleration, given the small amount of space available.

Terminal 1 is so structured as to combine perfectly with known metal guardrails 2, and provides for effective protection even in the event of impact by vehicles travelling on the other side of the road.

The advantages of terminal 1 are obvious: it provides for redirecting the vehicle towards the centre of the road, even in the worst possible conditions, and ensures, in any condition, deceleration well below current safety regulation thresholds.

Guardrail terminal 1 as described and illustrated herein also has the big advantage of being made from elements derived from currently used metal guardrails 2, thus greatly reducing production cost as compared with known terminals.

Clearly, changes may be made to terminal 1 as described and illustrated herein without, however, departing from the scope of the present invention.

In particular, in a variation not shown, as opposed to being curved, transverse horizontal retaining member 5 is straight, while still defining a substantially tear-shaped collapsible annular member 7 together with transverse horizontal retaining member 6. In this case, too, transverse horizontal retaining member 5 is obviously positioned in the horizontal plane so as to extend gradually away from edge 3 of the road, as of the end of guardrail 2.

What is claimed is:

1. A guardrail terminal comprising:

a plurality of vertical supporting members fixed to the ground one after the other along the edge of a road;

a first transverse horizontal retaining member fixed to the vertical supporting members at a height off the ground, and positioned in a horizontal plane so as to extend gradually away from the edge of the road, with the first transverse horizontal retaining member having a first end closer to the edge of the road than a terminal second end; and a second transverse horizontal retaining member which projects from the second end, curves back in the horizontal plane towards said first transverse horizontal retaining member, and is fixed by a terminal end to said first transverse horizontal retaining member, so as to define, together with the first transverse horizontal retaining member, a substantially tear-shaped collapsible annular member, wherein the second transverse horizontal retaining member further comprise an initial portion fixed to the terminal second end of said first transverse horizontal retaining member, and bent substantially into an L in the horizontal plane, so as to have, centrally, a given constant radius of curvature ($r_2$);

an intermediate portion bent substantially into a V in the horizontal plane, so as to have, centrally, a given constant radius of curvature ($r_3$); and an appropriately shaped end portion, the end of which is fixed directly to said first transverse horizontal retaining member.

2. A guardrail terminal as claimed in claim 1, wherein said first transverse horizontal retaining member is curved.

3. A guardrail terminal as claimed in claim 2, wherein said first transverse horizontal retaining member is curved in the horizontal plane with a constant radius of curvature ($r_1$).

4. A guardrail terminal as claimed in claim 1, wherein said first transverse horizontal retaining member comprises at least one segment of corrugated sheet metal with a three-ridge or W-shaped cross section.

5. A guardrail terminal as claimed in claim 1, wherein the end portion of said second transverse horizontal retaining member has a first portion and a second portion, and is bent substantially into an S in the horizontal plane, so that the first portion has a given first radius of curvature ($r_4$), and the second portion has a given second radius of curvature ($r_5$).

6. A guardrail terminal as claimed in claim 5, wherein the second portion of the end portion of said second transverse horizontal retaining member has a radius of curvature ($r_5$) substantially equal to the radius of curvature ($r_1$) of said first transverse horizontal retaining member, so that a portion of the length of the second portion overlaps the first transverse horizontal retaining member.

7. A guardrail terminal as claimed in claim 1, wherein said initial portion, said intermediate portion, and said end portion of said second transverse horizontal retaining member comprise at least one segment of corrugated sheet metal with a triple-ridge or W-shaped cross section.

* * * * *